United States Patent [19]

Baab

[11] Patent Number: 4,505,724

[45] Date of Patent: Mar. 19, 1985

[54] WET-PROCESS DUST-COLLECTING APPARATUS ESPECIALLY FOR CONVERTER EXHAUST GASES

[75] Inventor: Heribert Baab, Frankfurt am Main, Fed. Rep. of Germany

[73] Assignee: Metallgesellschaft Aktiengesellschaft, Frankfurt am Main, Fed. Rep. of Germany

[21] Appl. No.: 486,859

[22] Filed: Apr. 20, 1983

[30] Foreign Application Priority Data

Apr. 24, 1982 [DE] Fed. Rep. of Germany ..... 3215400

[51] Int. Cl.[3] ..... B03C 3/74

[52] U.S. Cl. ..... 55/118; 55/136

[58] Field of Search ..... 55/13, 118–120, 55/128, 136–138, 145, 148, 150, 151, 154

[56] References Cited

U.S. PATENT DOCUMENTS

| | | | |
|---|---|---|---|
| 1,250,088 | 12/1917 | Burns | 55/13 |
| 1,794,616 | 3/1931 | Hoss | 55/136 |
| 2,588,364 | 3/1952 | DeGiorgi | 55/145 |
| 2,847,802 | 2/1959 | Gustaffson et al. | 55/13 |
| 4,189,308 | 2/1980 | Feldman | 55/13 |

FOREIGN PATENT DOCUMENTS

| | | | |
|---|---|---|---|
| 553908 | 3/1958 | Canada | 55/128 |
| 2635789 | 2/1978 | Fed. Rep. of Germany | 55/138 |
| 18407 | 1/1914 | France | 55/138 |
| 904334 | 2/1945 | France | 55/118 |
| 1340195 | 12/1973 | United Kingdom | 55/13 |

*Primary Examiner*—Bernard Nozick

*Attorney, Agent, or Firm*—Karl F. Ross; Herbert Dubno

[57] ABSTRACT

Metallurgical converter gas is scrubbed in a wet-process electrostatic precipitator utilizing a cylindrical housing and axially separated collecting fields which themselves are vertically subdivided.

4 Claims, 5 Drawing Figures

WET-PROCESS DUST-COLLECTING APPARATUS ESPECIALLY FOR CONVERTER EXHAUST GASES

FIELD OF THE INVENTION

My present invention relates to a wet-process dust-collecting electrostastic precipitator of the type having a horizontal gas flow passage and, more particularly, to a wet electrostatic filter for removing particulates from metallurgical installations and especially for the removal of particulates from converter waste gases.

BACKGROUND OF THE INVENTION

Metallurgical-plant converters, utilized to perform refining operations on metallurigical melts, generally emit large volumes of exhaust gas which is made up of fumes, particulates, reaction products and entrained gases.

Before any part of these gases can be released into the environment for health and safety reasons, particulates must be removed therefrom and the removal of such particulates may be desirable on economical grounds as well to rectify variable components of the entrained solids.

The most frequently used gas cleaning system for the exhaust or waste gases of a converter, employs a scrubber generally having a cooling and saturating stage ahead of a scrubbing stage.

In the first stage, the exhaust gases can be cooled to a temperature of 60°-80° C. During the operation, the gases undergo a pressure drop of 200 to 400 mm water column. A pressure drop of 1200 to 1400 mm water column is required for the second stage. Because the dust is very fine, such scrubbers have been found to be effective only to remove dust in amounts above about 100 mg/m$^3$ STP, the gas containing a residual solids concentration of this magnitude.

Operation of scrubbers is energy intensive at least in part because of the substantial pressure drops, because of the need for blower power to develop such pressure drops.

Furthermore, because of the comparatively high residual dust content, the gases generally cannot be used directly for other purposes without further purification e.g. in a bag filter, and certainly cannot under existing environmental standards be released in whole or in part to the atmosphere.

In more modern plants, dry-process electrostatic precipitators have generally superceded scrubbers, because they can be operated with reduced pressure drops, residual dust concentrations and hence greater economy.

Further, dry process electrostatic precipitators cannot readily be installed in existing metallurgical plants to replace scrubbers, especially because they are not compatible with the preceding stages and because long term shutdown of the plant would have to be contemplated along with considerable redesign. In some gases, the space requirements for dry-process scrubbers will not admit of such replacement in any event.

Obviously an attack on the problem may be made by providing wet-process electrostastic precipitators in place of the energy consuming scrubbing or second stage of the conventional scrubbing process hitherto used. This could avoid a prolonged shutdown because the entire wet-process precipitator could be fabricated off site, transported to the plant and installed with a minimum of down time while the steel works continues its production and the gas flow paths connected to the new unit.

Further, while considerable interest has been expressed in this possibility, as far as I am aware, prior to the contribution described below, there has been no significant success in the use of wet-process electrostatic precipitators in the treatment of exhaust gases from metallurigical plant converters and especially from steel making converters.

Apparently, if there have been earlier efforts to utilize electrostatic precipitators for converters, these have proved to be unsuccessful because of difficulties engendered by the composition of the converter waste gas. Converter waste gases are notoriously explosive and combustible so that in the handling of them, there is always the risk of detonation not only in the treating unit itself, but in the entire system.

Electrostatic precipitators have been provided in systems sensitive to explosion with pressure resistant housings or even housings with portions which can be readily displaced to release the energy of explosions but, as far as I am aware, these have not been utilized with great success for converter gases if at all.

Other problems which may have been encountered heretofore and have contributed to the difficulties may derive from the need for extremely large flow cross sections because of the need to treat extremely large volumetric flows which are generated for brief periods of time at high velocities and the difficulties which have hithereto been encountered in treating gases at the available velocities of 1 to 1.8 meters per second. Theoretically, using conventional designs and the requirements for processing converter gases, it has been calculated that electrode heights of 10 meters or more may be required. This of course creates a problem with respect to the stability of the electrode system and introduces the need for stabilizing or regidifying structures.

It would be desirable to utilize electrode plates with a height of 3 to 5 meters at a maximum, but such plates utilizing conventional precipitator designs cannot effectively be rinsed under the conditions contemplated for the treatment of converter gases.

Exhaust gases from a converter are usually saturated before entering the collected fields of the precipitator so that condensate as well as moist dust accumulates on the collecting electrodes.

Generally speaking exhaust gases from a converter are available only intermittently so that adequate time between treatment intervals is available for rinsing and hence continuous rinsing is not necessary. During the blowing period, however, the gas is supplied at such rates that rinsing must in any event be interrupted so that the electrostatic precipitator can be operated on the highest possible voltage. Obviously voltage control fails if high voltage levels are applied concurrently with rinsing.

When the dust collected in a moist state or as a sludge is to be removed by liquid sprayed from nozzles disposed outside the electrical field, the jets of spray must be sufficiently fine to allow a substantially uniform distribution over the plates, but each individual streamlet must impinge with an energy sufficient to scrub the plate free from the collected dust or sludge.

Experience has shown that the two requirements of uniform fine spray and high voltage streamlets cannot be met at the same time unless the spraying nozzle is brought sufficiently close to the surface that the kinetic energy of the streamlet will not significantly drop after leaving the spraying jet. For practical reasons, therefore, the height of thes collecting electrode plate must be kept between 3 and 5 meters since greater heights will interfere with the spray requirements and require the stabilizing structures and smaller heights are impractical.

Furthermore present environmental and economical requirements mandate that the precipitator purify the gases to a residual solids content no greater than 10 $mg/m^3$ STP at a much lower pressure drop than previously utilized for scrubbers.

OBJECTS OF THE INVENTION

It is the principal object of the present invention, therefore, to provide an improved wet-process electrostatic filter or dust-removal installation which can satisfy the requirements outlined above for use with converter waste gases.

Another object of this invention is to provide an electrostatic precipitator for the purposes described which is capable of resisting pressure surges which may result from detonation of explosive gases and yet is of economical construction and operation.

Still another object of my invention is to provide an improved wet-process electrostatic precipitator which is capable of treating converter exhaust gases from steel making Bessemer or Thomas converters or other steel-refining converters and wherein the dust removal is effective to values below 10 $mg/m^3$ STP for carbon monoxide and like explosive or detonation-susceptible gases.

It is also an object of this invention to provide an electrostatic precipitator with the aforementioned advantages and properties which can be operated with a reduced pressure gradient or drop, more economically and with greater efficiency of plate rinsing such that effective rinsing can result even if it is only carried out in the nonblowing periods of converter operation.

SUMMARY OF THE INVENTION

These objects and others which will become apparent hereinafter are attained, in accordance with the invention, in a wet-process electrostatic precipitator, especially for steel-making converter waste gases, which comprises a cylindrical pressure-resisting steel housing of circular cross section and a cross-sectional area providing a flow cross section of at least 20 $m^2$, one or a plurality of collecting fields disposed one behind another and arranged in the direction of gas flow, i.e. in axially offset relationship, each of these fields being subdivided into at least two sections which are separated from one another in the verticle direction, the housing being horizontal and the collecting plates being disposed in vertical planes.

According to the invention, moreover, in each of these sections which are referred to respectively, for convenience, as upper and lower sections, the corona electrodes and the collecting electrodes are regularly spaced apart and alternate with one another in a direction transverse to the direction of gas flow which is axially.

Finally, according to the invention, the electrodes and the rinsing nozzles are suspended at least in part in a staggered relationship utilizing special supports which are described in greater detail below.

The present invention also comprehends a method of operating the wet-process electrostatic precipitator which utilizes some of the advantages gained by the structure. According to this invention, liquid is sprayed to rinse the plates while high voltage is applied and while the gas supply is cut off, i.e. during the periods between blows of the converter.

According to another feature of this invention, the separation planes of the two sections of each field in each axial zone of the housing is vertically offset from the separating plane between the sections of an adjacent field and, indeed the separating planes can alternate along the cylindrical housing between relatively high and relatively low separating planes.

According to yet another feature of this invention, the upper section of each field is offset by half the width of the field from the lower section of the field. Consequently, each upper collecting plate is located substantially in a median plane between two collecting plates of the lower field, although spaced above and hence each plate of the lower section can be located in a median plane between two plates of the upper section. The term "median plane" is here used to mean a plane midway between a pair of plates.

The lower edges of the collecting electrodes of the upper section can be provided with the spray nozzles for the collecting plates of the lower section and the nozzles for rinsing the plates of the upper section can be provided at the upper portions of the median plane therebetween.

For each section, the collecting plates can be equispaced vertical plates defining gas flow passages or channels between them and in the midst of these channels, i.e. along the aforementioned median plane, the corona electrodes can be provided. Along the median planes moreover, supports can be disposed for the corona electrodes and the spray nozzles and these supports can include or can be provided in addition to liquid inlets feeding the upper nozzles.

Because of the cylindrical configuration of the housing, the plates increase in height laterally inwardly substantially symmetrically with respect to a vertical axial median plane through the apparatus.

BRIEF DESCRIPTION OF THE DRAWING

The above and other objects, features and advantages of the present invention will become more readily apparent from the following description, reference being made to the accompanying drawing in which.

SPECIFIC DESCRIPTION

While, for the sake of illustration, in certain of the figures the nozzles for the corona discharge electrodes have been omitted, it will be understood that in the complete electrostatic precipitator of the invention, the corona discharge electrodes and the nozzles are juxtaposed in the manner which will be described with the collecting electrodes, all within the cylindrical pressure resisting housing, and are held therein by appropriate supports which have been shown somewhat diagrammatically.

Figure 1:
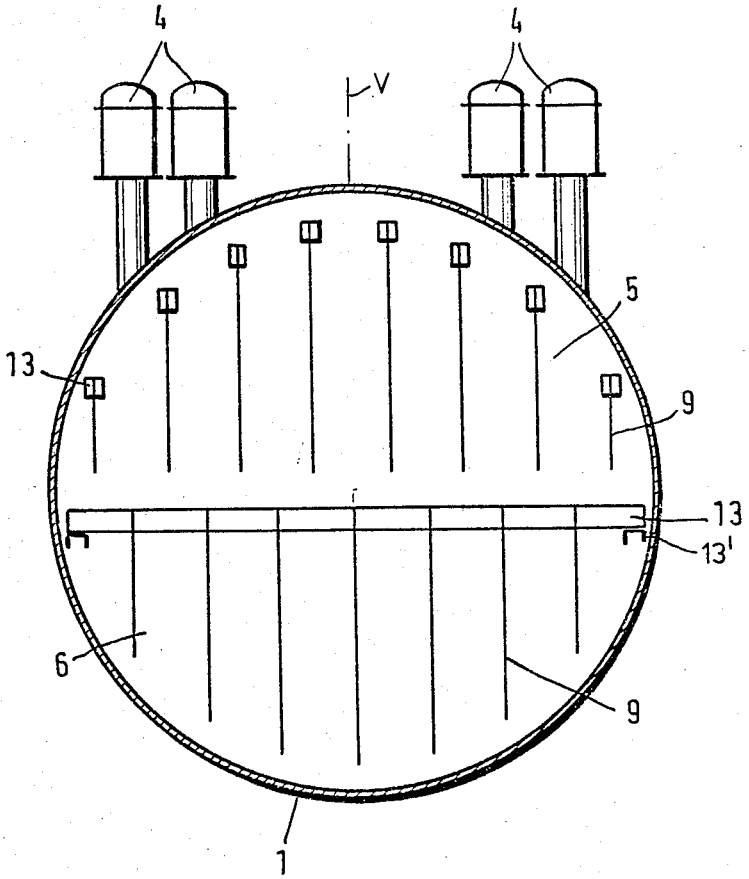
FIG. 1 is a diagrammatic transverse sectional view through a wet-process electrostatic precipitator in which the corona electrodes have been omitted to simplify the showing of the collecting electrodes, and the collecting electrodes have been shown in a simplified form with single lines.
Figure 2:
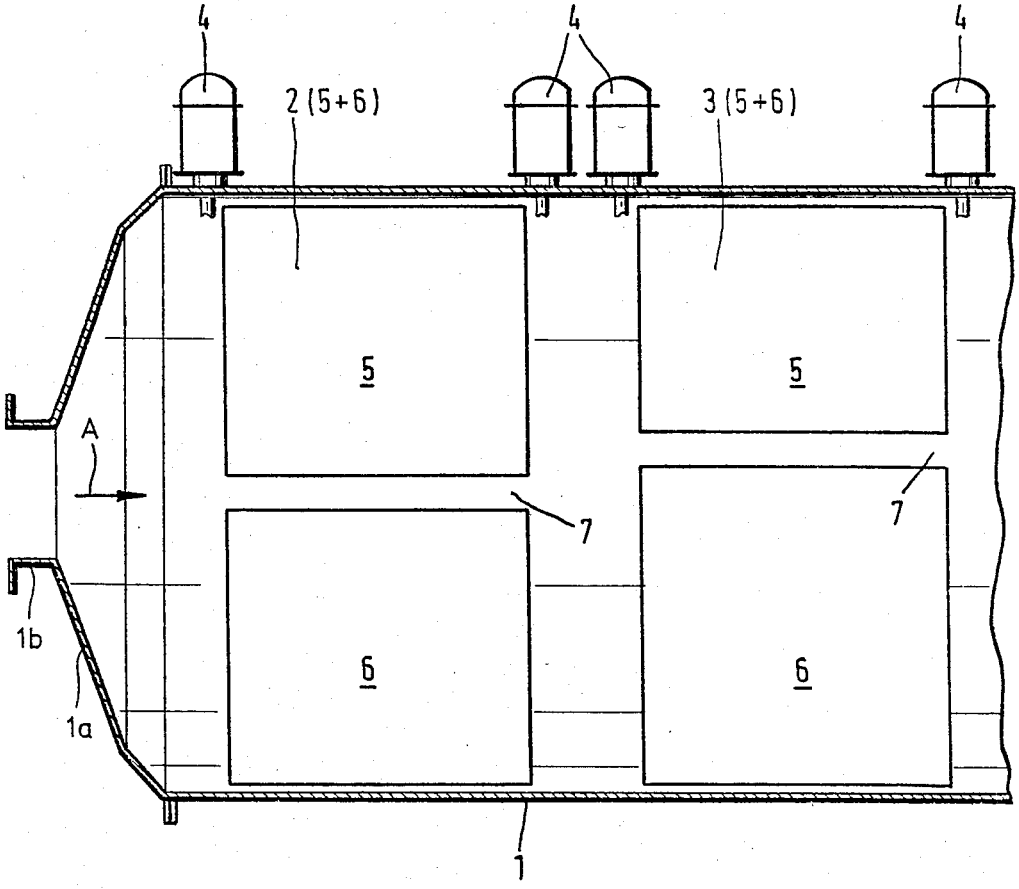
FIG. 2 is a fragmentary longitudinal section through the electrostatic precipitator again without the corona discharge electrodes.

More particularly, as has been shown in FIG. 1, the housing 1 is circularly cylindrical, composed of steel, and fabricated as a conventional cylindrical pressure vessel oriented so that its axis is horizontal and assembled, for example, with domed ends, one of which has been shown at 1*a* in FIG. 2, or like pressure-resisting members provided with fittings such as that shown at 1*b* which constitutes the inlet. A corresponding axial outlet, not shown, is also provided.

The minimum flow cross section over the cylindrical region should be 20 $m^2$.

The length of the housing can be at least twice its diameter and preferably many times greater than its diameter and will depend, of course, on the number of collecting fields which are disposed in axially spaced apart relationship over the length of this housing.

The respective fields are made up of collecting electrode plates 9 which lie in vertical planes and which are horizontally spaced apart to extend parallel to the direction of gas flow which is perpendicular to the plane of the paper in FIG. 1.

The plates 9 for each field are relatively short laterally of the filter and increase in height, stepwise inwardly to a maximum height at or proximal to a vertical median plane V extending along the axis of the apparatus.

Each of the plates is suspended from its edge by a respective support 13. The supports 13 can be bars which themselves rest at their ends upon channels 13', for example, mounted in the housing. The collecting electrodes can electrically connect with the housing so as to be at the same potential as the housing. Naturally, both the housing and these electrodes will be insulated from the corona discharge electrodes which will be described subsequently and which can be brought to a potential different from ground potential with a high voltage, e.g. of the order of thousands of volts representing the potential difference between the corona electrodes and the collecting electrodes.

In FIG. 2, the collecting electrodes 9 are shown to be divided into two axially spaced fields 2 and 3, respectively, although in practice any number of such fields may be used, e.g. say up to ten.

Each collecting field 2, 3, . . . is subdivided in turn, in height into an upper section 5 and a lower section 6. Where appropriate, more than two vertically spaced sections can be provided, in each case there will be upper, lower and intermediate sections to form each field.

Separate supports 13 are therefore provided for the respective sections.

The collecting electrodes 9 of the lower section are transversely offset by one half of the width of a gas passage defined between each two collecting plates, from the collecting electrodes 9 of the upper section 5 as will be discussed in greater detail in connection with FIG. 5.

The corona discharge electrodes 11 can be mounted on frames insulated from the housing and supported by rods 4*a* (FIG. 3) which themselves are supported by insulators within pipes 4*b* in housings 4*c*, the supports for the corona electrodes being generally represented at 4.

From FIG. 2 it will be apparent that each field is separated by a horizontal separating plane 7 into its sections and that each plane 7 of one field is staggered vertically with respect to the separating plane of an adjacent field. Thus, as shown in FIG. 2, the downstream field 3 has its separating plane located above the separating plane 7 of the upstream field 2. The next field may have its separating plane above or below the separating plane 7 of field 3.

In this figure, moreover, the direction of gas flow has been represented by the arrow A.

Figure 3:
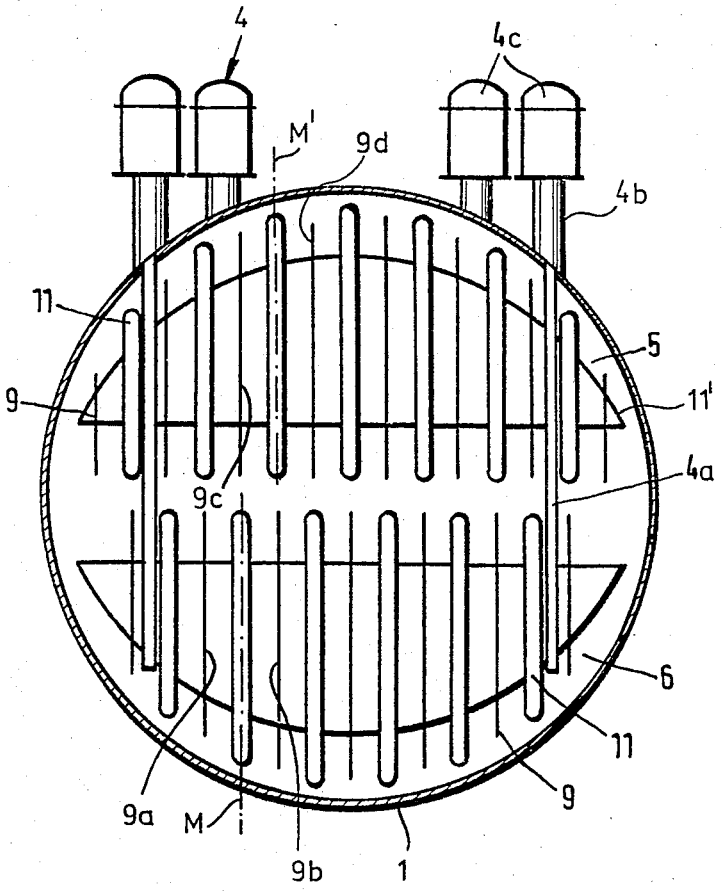
FIG. 3 is a transverse sectional view generally corresponding to FIG. 1 showing the corona electrodes in place and a simplified support structure.

In FIG. 3, I have shown in relationship between the corona electrodes 11 and the collecting electrodes 9 in greater detail. Since the corona electrodes 11 of each upper field are located in the vertical median plane between the collecting electrodes of this section of the field, they are located in the upward or downward extensions of the collecting plates of the other section. Conversely, each collecting plate of an upper section is located in the median plane M, for example, between two collecting plates 9*a* and 9*b* of the lower section while each corona electrode 11 of the upper section is located in a median plane M' between two plates, e.g. 9*c* and 9*d* of the upper section and coplanar with a plate e.g. 9*b* of the lower section.

The supports for the electrodes in FIG. 3 have been omitted for clarity.

Figure 4:
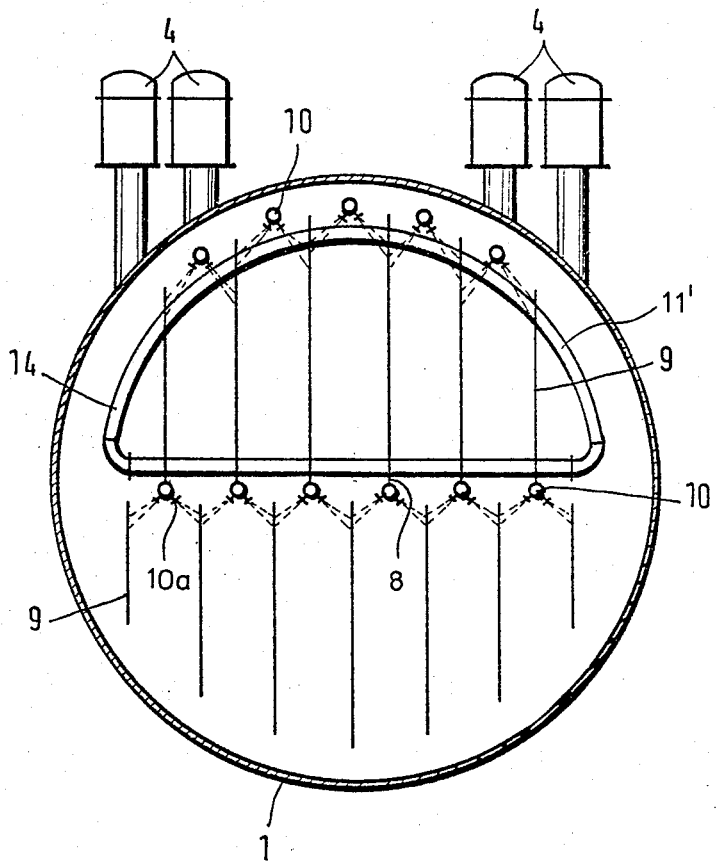
FIG. 4 is another transverse sectional view in which the corona discharge electrodes have been omitted but the spray nozzles have been shown.

The frames 11' carrying the corona electrodes have also been shown diagrammatically in FIGS. 3 and 4 and any conventional art recognized support system for the electrodes may be used.

However it is important to the invention, as shown in FIG. 4, to provide, in addition to the supports, semicircular liquid supply pipes 14, which communicate a feed line, not shown, insulated from the housing and the corona electrodes and which deliver water or other rinsing liquid to tubes 10 which extend parallel to the axis of the housing between the upper edges of each pair of collecting plates. As can be seen from FIG. 4, the rinsing tubes 10 can be electrically connected to the plates 9 and indeed can be formed on or can serve to position the lower edges 8 of the plates 9 of the respective upper section.

The tubes 10 are formed with nozzles 10*a* shown diagrammatically to direct respective divergent jets of liquid onto the collecting plates 9 between which they are disposed.

The height division is achieved in this system so as to enable each collecting electrode plate to have a height of 3 to 5 meters, while each field can have a total height significantly in excess of this limiting height.

The rinsing tubes here serve to position the collecting electrodes and to assist in the field division without large space requirements and while minimizing the field-free cross section for flow of the gas. This has been found to be important for optimum cleaning of the plates.

Figure 5:
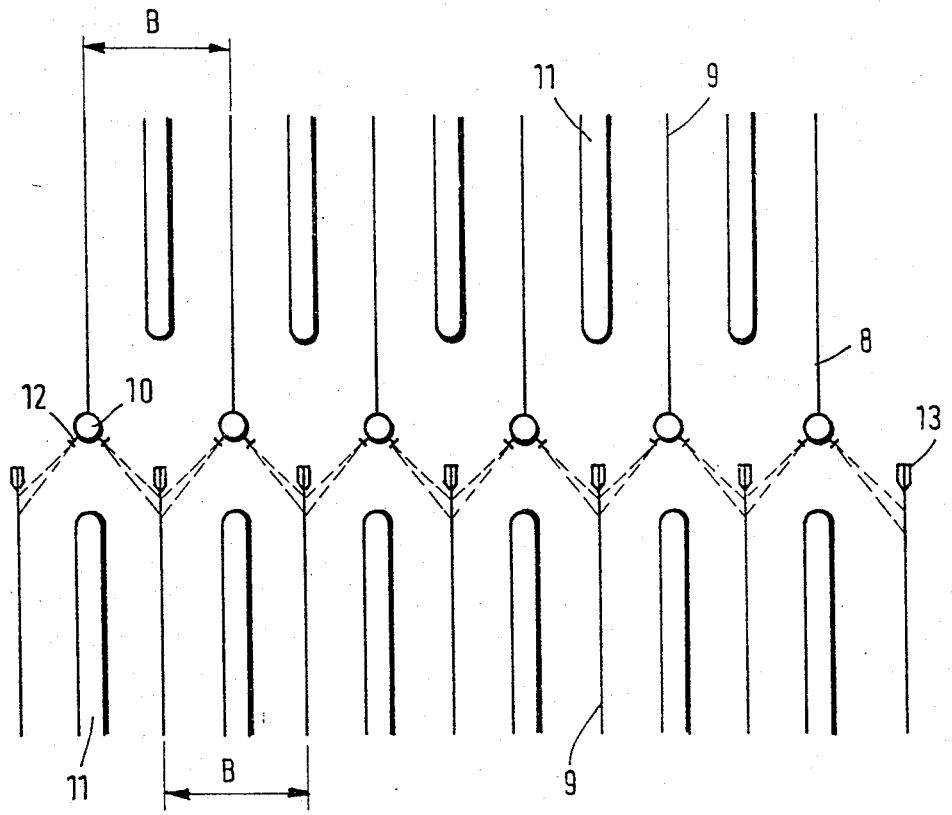
FIG. 5 is a diagrammatic detail view showing the relationship between collecting nozzles, the spray nozzles, the collecting electrodes and the corona discharge electrodes.

The arrangement at a parting plane between the upper and lower sections of the collecting fields has been shown diagrammatically but to a larger scale in FIG. 5. The collecting electrodes alternate with corona electrodes and are offset in the manner described.

The electrostatic precipitator described and illustrated has been found to be capable of reducing the particulates content of the gas traversing it to 10 mg per $m^3$ or less STP, to be inexpensive to manufacture and operate, and to function with a minimum pressure drop. The energy requirements are therefore significantly reduced.

I claim:

1. A wet-process electrostatic precipitator, especially for the removal of particulates from a metallurgical converter waste gas, comprising:

a pressure-resisting horizontally disposed axially elongated cylindrical housing traversed axially by said gas;

a plurality of collecting fields axially spaced apart in said housing and each comprising a plurality of transversely spaced mutually parallel upper vertical collecting plates extending in the direction of gas flow, and a plurality of transversely spaced mutually parallel lower vertical collecting plates extending in the direction of the flow below the respective pluralities of upper plates so that the upper and lower plates of each field form respective field sections vertically subdivided from one another;

upper corona electrodes disposed in said housing between said upper plates and lower corona electrodes disposed in said houses between lower plates of each field and in gas flow channels defined between said plates, the upper and lower plates and corona electrodes of each field being separated by a horizontal separating plane between the respective sections; and rinsing means including nozzles for each of said fields directing a rinsing liquid onto said plate to wash collected particulates therefrom, the separating planes of successive fields in the direction of gas flow being vertically staggered, the collecting plates of each section of each field being transversely offset from the collecting plates of an adjoining section of the same field by a distance equal to half the width of the gas channels defined between the collecting plates of each section.

2. The electrostastic precipitator defined in claim 1 wherein said rinsing means includes rinsing tubes extending between each pair of collecting plates of the upper section of each field and directing outwardly jets of liquid onto the plates of the respective pairs.

3. The electrostastic precipitator defined in claim 1 wherein said rinsing means includes a spray tube extending along the lower edge of each collecting plate of an upper section of the respective field and supporting said lower edge while directing jets of liquid between two collecting plates of a lower section of the respective fields.

4. The electrostastic precipitator defined in claim 3 wherein said rinsing means includes rinsing tubes extending between each pair of collecting plates of the upper section of each field and directing outwardly jets of liquid onto the plates of the respective pairs.

* * * * *